US005580115A

United States Patent [19]

Jessen

[11] Patent Number: 5,580,115

[45] Date of Patent: Dec. 3, 1996

[54] LOAD-ENGAGING DEVICE FOR HOISTING CONCRETE BUILDING ELEMENTS

[76] Inventor: Laurids A. Jessen, Strandhuse 54A, 5700 Svendborg, Denmark

[21] Appl. No.: 411,825

[22] PCT Filed: Oct. 4, 1993

[86] PCT No.: PCT/DK93/00322

§ 371 Date: May 30, 1995

§ 102(e) Date: May 30, 1995

[87] PCT Pub. No.: WO94/08885

PCT Pub. Date: Apr. 28, 1994

[30] Foreign Application Priority Data

Oct. 12, 1992 [DK] Denmark ..... 1284/92

[51] Int. Cl.[6] ..... B66C 1/66

[52] U.S. Cl. ..... 294/89; 294/82.31

[58] Field of Search ..... 294/82.1, 82.11, 294/82.31, 89, 90; 52/125.2, 125.4, 125.5

[56] References Cited

U.S. PATENT DOCUMENTS

| | | | |
|---|---|---|---|
| 3,499,676 | 3/1970 | Haeussler | 294/89 X |
| 4,173,367 | 11/1979 | Haeussler | 294/89 X |
| 4,398,762 | 8/1983 | Haeussler et al. | 294/89 |
| 4,615,554 | 10/1986 | Schilla et al. | 294/89 |
| 4,703,595 | 11/1987 | Zipf et al. | 294/89 X |

FOREIGN PATENT DOCUMENTS

| | | | |
|---|---|---|---|
| 259295 | 7/1987 | European Pat. Off. . | |
| 2643672 | 8/1990 | France | 294/89 |
| 2610195 | 9/1977 | Germany | 294/89 |
| 2906616 | 8/1980 | Germany | 294/89 |
| 3012280 | 7/1982 | Germany . | |
| 3012278 | 10/1983 | Germany . | |

*Primary Examiner*—Johnny D. Cherry
*Attorney, Agent, or Firm*—Dorsey & Whitney LLP

[57] ABSTRACT

With a view to being placed about the head of a lifting bolt placed in a hemispherical recess in a concrete building element, the load-engaging device for hoisting the concreted building element comprises a body having a spherical surface. An arm having an abutment surface protrudes from the body and is used for turning the body in the recess. The body further comprises an inverted T-shaped slot extending through approximately 180 degrees along the spherical surface of the body. This T-shaped slot is adapted to receive the head of the lifting bolt. A central slot extends approximately diametrically through the body and opens into the inverted T-shaped slot. A bolt placed eccentrically about the abutment surface extends across the central slot and is secured in bores in the body. A connecting member is placed in the central slot and retained by the bolt. This load-engaging device prevents the head of the lifting bolt from being released from the device when the concrete element is being hoisted.

11 Claims, 3 Drawing Sheets

LOAD-ENGAGING DEVICE FOR HOISTING CONCRETE BUILDING ELEMENTS

TECHNICAL FIELD

The invention relates to a load-engaging device for hoisting concrete building elements.

BACKGROUND ART

A device of the kind referred to above is described in DE Patent Publications Nos. 3,012,278 and 3,012,280, relating to an apparatus for suspending a concrete body in a hoisting apparatus. In this apparatus, the load-engaging tackle comprises a suspending shackle with a link eye extending through a link bore through the middle of the body, and an inadvertent release of the head of the lifting bolt is prevented by the manipulating arm abutting against a rib in this suspending shackle, if the situation entails a risk of such a release.

DISCLOSURE OF THE INVENTION

It is the object of the invention to provide a load-engaging device of the kind referred to initially that allows forces to be exerted on the lifting bolt at an oblique angle of e.g. 45 degrees with the surface of the concrete element without risk of the head of the lifting bolt being released, said device at the same time being capable of use with various hoisting-connecting means.

Since the load-engaging device according to the invention after having been attached to the lifting bolt, but before the lifting of the concrete element, is freely rotatable about this bolt in the hemispherical recess, it is always possible, with a view to oblique forces being exerted subsequently on the device, to turn the manipulating arm so as to make it face in the direction, from which the force is exerted, and since the force is transmitted to the bolt situated eccentrically relative to the abutment surface of the manipulating arm, this abutment surface will be pressed against the surface of the concrete element, so that it is no longer possible to turn the body in the recess to that position, in which the head of the lifting bolt can be released. At the same time, it is possible to attach various hoisting-connecting means to the bolt extending through the central slot in the body.

If the load-engaging device according to the invention constitutes a part of a ready-made hoisting sling comprising a chain, the end link of the chain is retained in the central slot by a bolt.

If the connecting means is a hook or a shackle, then an universal joint is used to engage the shackle or hook.

BRIEF DESCRIPTION OF THE DRAWINGS

In the following detailed portion of the present description, the invention will be explained in more detail with reference to the exemplary embodiment of a load-engaging device according to the invention shown in the drawings, in which.

DESCRIPTION OF THE PREFERRED EMBODIMENT

Figure 1:
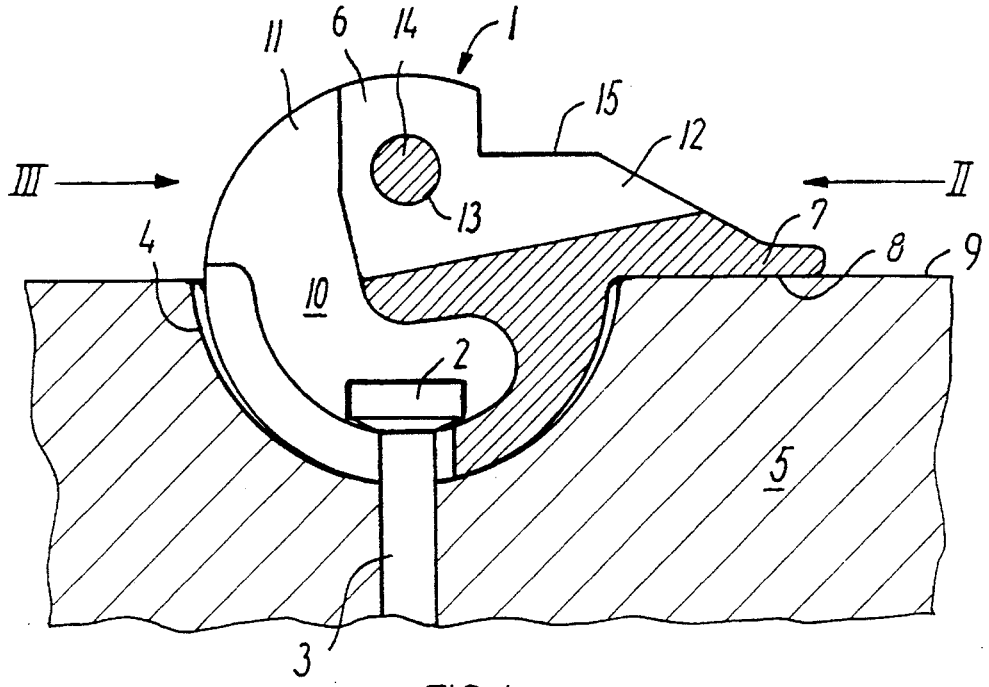
FIG. 1 shows the load-engaging device in section along the line I—I in FIG. 2*a*.
Figure 2A:
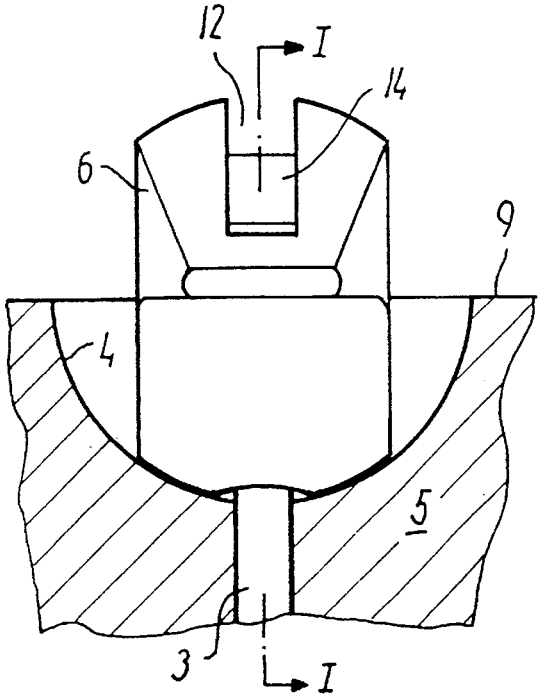
FIG. 2*a* shows the device as viewed in the direction of the arrow II in FIG. 1.
Figure 2B:
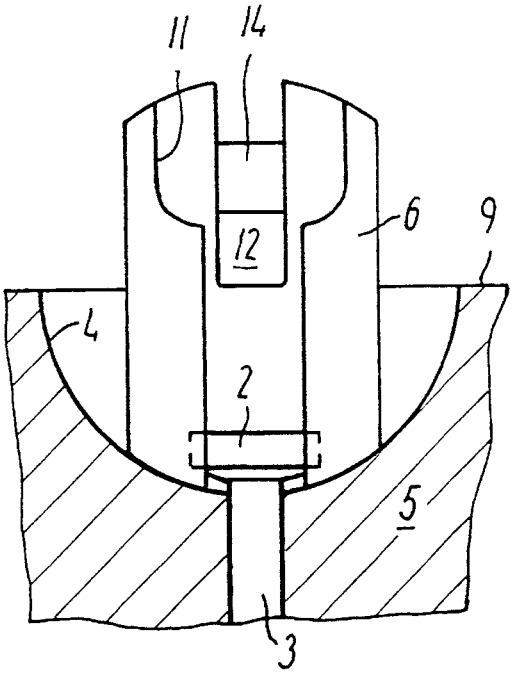
FIG. 2*b* shows the device as viewed in the direction of the arrow III in FIG. 1.
Figure 4:
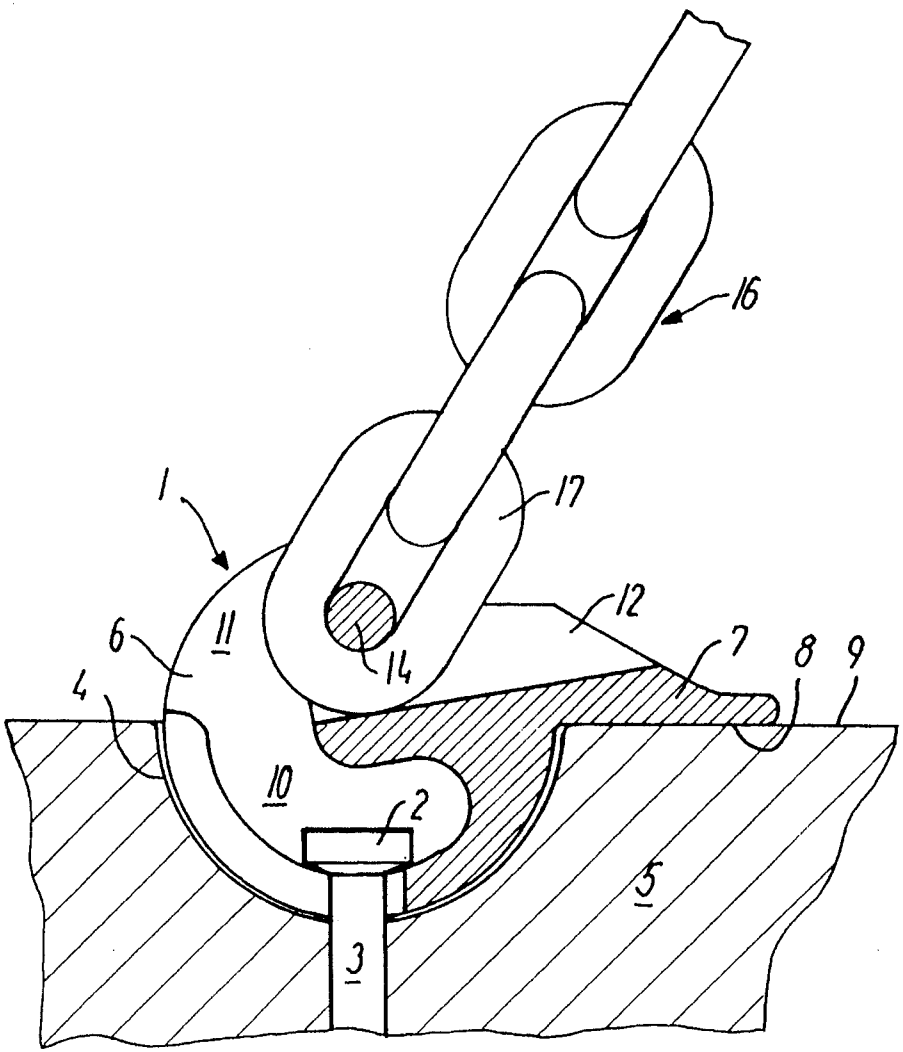
Figure 3:
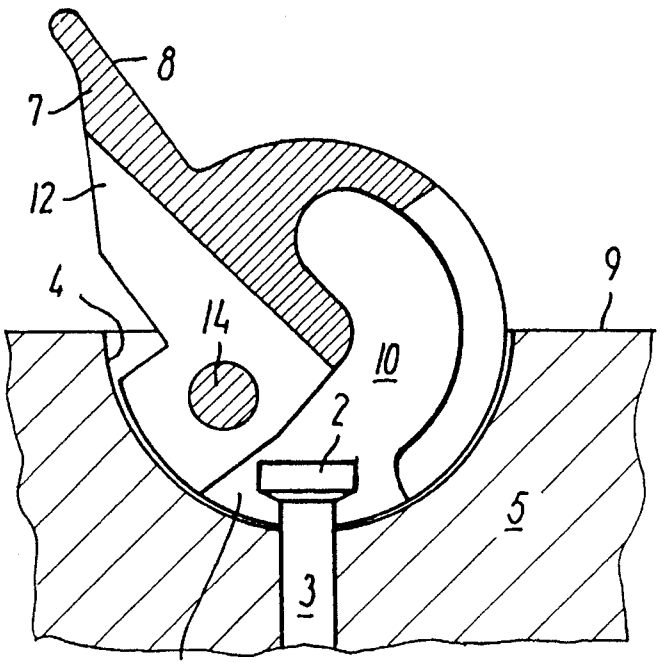
FIG. 3 shows the device being attached to a lifting bolt, FIG. 4 in the same manner as in FIG. 1 shows a chain secured to the device, and FIG. 5 in the same manner as in FIGS. 1 and 3 shows the load-engaging device connected to the eye of a shackle through a universal joint.

FIGS. 1, 3, and 4 show a load-engaging device according to the invention, generally designated by the reference numeral 1, as shown in the drawing placed in a securing manner about the head 2 and a part of the stem 3 on a lifting bolt embedded in a hemispherical recess 4 in a concrete building element 5, of which only a part is shown. The device 1 comprises a body 6 symmetrical about a central plane corresponding to the sectional line I—I in FIG. 2*a*, in the form of a central segment of a sphere with a slightly smaller diameter than the hemispherical recess 4, having a protruding manipulating arm 7 with an abutment surface 8 extending radially relative to the body 6, said surface 8 being adapted to abut against the surface 9 of the concrete element 5, when the device 1 is placed in a securing manner on the head 2 of the lifting bolt 2,3. When the device 1 is to be placed about the head 2 on a lifting bolt 2,3, the arm 7 is used for turning the body 6 relative to the head 2 to the position shown in FIG. 3.

The body 6 comprises an inverted T-shaped slot 10 extending along its spherical surface and adapted to receive the head 2 and a part of the stem 3 of the lifting bolt. In the securing position for the lifting bolt 2,3, its stem 3 forms an angle of about 90 degrees with the abutment surface 8 on the arm 7 abutting against the surface 9 on the concrete element 5, and the head 2 on the lifting bolt is positioned at the inner, closed end of the T-slot 10. At the other end of the latter, there is a cut-out 11 making it possible to introduce the head 2 of the lifting bolt in the part of the T-slot 10 corresponding to the crossbeam in the T, a part of the stem 3 of the lifting bolt being introduced in the part of the slot 10 corresponding to the vertical beam in the T, when the load-engaging device 1 is in the position shown in FIG. 3 in the hemispherical recess 4 in the concrete element 5. In the same position, the lifting bolt 2,3 may be released from the load-engaging device 1.

A slot 12 for receiving a chosen connecting means in a manner to be explained below extends centrally and substantially diametrically in the body 6 and opens into the T-slot 10. Mutually aligned bores 13 are situated eccentrically in the body 6 and diametrically opposite to the retaining position for the lifting bolt 2,3 shown in FIG. 1, i.e. penetrating the body and the slot 12 at right angles in a diametral plane through the body 6 at right angles to the abutment surface on the manipulating arm 7; these bores 13 are adapted to receive a bolt 14 for securing the connection means, the bolt 14 being removably secured in the body 6 by means of a pin (not shown). Finally, the body 6 comprises an incision 15 above and parallel to the abutment surface 8, the function of which will be explained below with reference to FIG. 5.

FIG. 4 shows the load-engaging device according to the invention in operation with a chain 16 as connecting means, the chain 16 being secured to the body 6 by having its end link 17 placed within the slot 10, the bolt 14 having subsequently been inserted through this link 17.

When, as shown in FIG. 4, there is an oblique pull in the chain 16, this pull will exert a turning moment on the body 6, causing the abutment surface 8 on the arm 7 to be pressed firmly against the surface 9 on the concrete element 5. Thus, there is no possibility, when the concrete element 5 is being lifted, that the body 6 can turn away from the position shown in FIG. 4 to the release position shown in FIG. 3.

Figure 5:
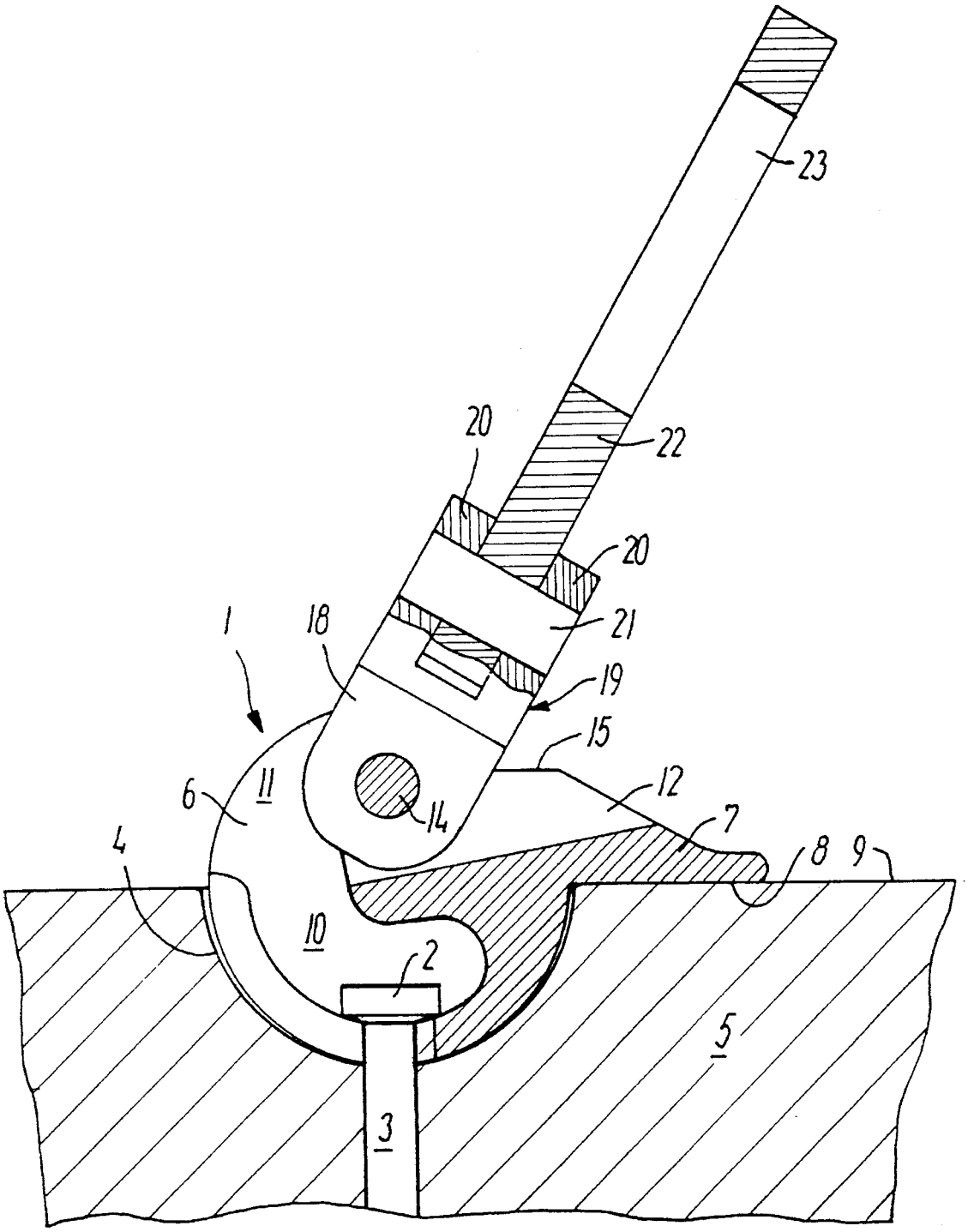

FIG. 5 shows an embodiment of the load-engaging device according to the invention intended for use with connecting means like a hook or a shackle (not shown). In this embodiment, a lug 18 on a universal joint generally designated 19 is introduced in the slot 12 in the body 6 and retained therein by having the bolt 14 extending through a bore in the lug 18. Transversely to the lug 18, the universal joint 19 comprises a fork, through the legs 20 of which there are mutually aligned bores receiving a bolt 21, likewise extending through a bore in a lug 22 having an eye 23 for receiving a shackle or a hook. As shown, the incision 15 allows the universal joint 19 and with it the lug 22 and the eye 23 to be turned about the bolt 14 to a position, in which they form an angle of approximately 45 degrees with the surface 9 of the concrete element 5. When the hook or the shackle as shown in FIG. 5 pulls obliquely upwards on the eye 23, the same force relationships apply as explained above with reference to FIG. 4, and the body 6 cannot turn away from the retaining position shown to the release position for the head 2 on the lifting bolt 2,3 shown in FIG. 3.

I claim:

1. Load-engaging device (1) to be placed securingly about a head (2) on a lifting bolt having a head and a stem (2, 3) embedded in a hemispherical recess (4) in a concrete building element (5) for hoisting the latter with the aid of a hoisting apparatus and the load-engaging device comprising a body (6) that is symmetrical about a central plane (I—I), having a spherical surface, and fitting into said hemispherical recess (4), said body (6) comprising a protruding manipulating arm (7) with an abutment surface (8) extending substantially radially relative to the body (6), the latter also comprising an inverted T-shaped slot (10) extending through approximately 180 degrees along the spherical surface of the body (6) and adapted to receive the head (2) and a part of the stem (3) of said lifting bolt (2, 3) and the inverted T-shaped slot (10) having a retaining position to retain the latter in a position, in which the stem (3) forms an angle of approximately 90 degrees with the abutment surface (8) on the arm (7), said inverted T-shaped slot (10) at its end opposite to the retaining position for the lifting bolt (2, 3) having a cut-out (11), through which the head (2) of the lifting bolt (2, 3) may be inserted in and removed from said inverted T-shaped slot (10), characterized in a) that a central slot (12) extends centrally and substantially diametrically in the body (6) and opens into the inverted T-shaped slot (10), and b) that mutually aligned bores (13) for receiving a bolt (14) for attachment of a connecting means to the body (6) extend within the region of said slot (12) eccentrically in the body (6) and substantially diametrically opposite the retaining position for the lifting bolt (2, 3).

2. Load-engaging device according to claim 1, characterized in that the connecting means is a chain (16) having an end link (17), the end link (17) of which is retained in the central slot (12) by the bolt (14) through the central slot.

3. Load-engaging device according to claim 1, characterized by an universal joint (19) having a first lug (18) with a through bore retained by the bolt (14) through the central slot (12), as well as a fork having legs (20) placed transversely of said first lug (18) with mutually aligned bores extending through the legs (20) of said fork for receiving a bolt (21), to which a second lug (22) is secured between the legs (20) of the fork, said second lug (22) having an eye (23) for engaging a connecting means.

4. A load-engaging device for lifting an element from which projects a lifting bolt having a head and a stem, comprising:

(a) a body (6) having a partial spherical surface;

(b) a manipulating arm (7) protruding from the body (6);

(c) the body (6) having a receiving slot (10) adapted to receive the head (2) and part of the stem (3) of the lifting bolt, the receiving slot having a head receiving cut-out with a width greater than the width of the head (2) of the lifting bolt, the receiving slot having a stem receiving slot with a width greater than the width of the stem of the lifting bolt, the stem receiving slot is in communication with the head receiving cut-out;

(d) a connection slot (12) opening into the receiving slot (10); and (e) attachment means which extend within the region of the connection slot (12) for attaching a connecting means to the body.

5. The load-engaging device of claim 4, wherein the receiving slot has a retaining position.

6. The load-engaging device of claim 5, wherein the attachment means extends within the region of the slot (12) eccentrically in the body (6).

7. The load-engaging device of claim 6, wherein the attachment means is substantially diametrically opposite the retaining position for the lifting bolt.

8. The load-engaging device of claim 7, wherein the attachment means comprises mutually aligned bores (13) for receiving a bolt (14).

9. The load-engaging device of claim 4, wherein the connection slot (12) extends centrally and substantially diametrically in the body (6).

10. The load-engaging device of claim 4, wherein the receiving slot (10) extends through approximately 180 degrees along the partial spherical surface of the body.

11. The load-engaging device of claim 4, wherein the body has a partially spherical surface limited by parallel segmenting planes.

* * * * *